US009033036B2

(12) United States Patent
Wilkinson et al.

(10) Patent No.: US 9,033,036 B2
(45) Date of Patent: May 19, 2015

(54) APPARATUS AND METHOD FOR MONITORING CORROSION AND CRACKING OF ALLOYS DURING LIVE WELL TESTING

(75) Inventors: Christian Wilkinson, Houston, TX (US); Indranil Roy, Sugar Land, TX (US); Stephane Hiron, Igny (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 392 days.

(21) Appl. No.: 13/106,036

(22) Filed: May 12, 2011

(65) Prior Publication Data

US 2011/0277995 A1 Nov. 17, 2011

Related U.S. Application Data

(60) Provisional application No. 61/334,170, filed on May 12, 2010.

(51) Int. Cl.
*E21B 47/00* (2012.01)

(52) U.S. Cl.
CPC ..... *E21B 47/00* (2013.01); *Y10S 166/902* (2013.01)

(58) Field of Classification Search
CPC ..... E21B 41/02; E21B 47/00; E21B 49/087; E21B 47/124; E21B 47/011; E21B 17/042; G01N 17/04; G01N 17/043; G01N 17/046; Y10S 166/902
USPC ..... 166/250.05, 113, 242.4, 902
See application file for complete search history.

(56) References Cited

U.S. PATENT DOCUMENTS

| | | | | |
|---|---|---|---|---|
| 4,267,148 | A * | 5/1981 | Dickson et al. | 422/53 |
| 4,359,898 | A | 11/1982 | Tanguy et al. | |
| 4,483,397 | A * | 11/1984 | Gray | 166/250.11 |
| 4,501,323 | A * | 2/1985 | Lively et al. | 166/250.11 |
| 4,603,113 | A * | 7/1986 | Bauer | 436/6 |
| 4,605,065 | A * | 8/1986 | Abercrombie | 166/250.11 |
| 4,688,638 | A * | 8/1987 | Williams | 166/250.11 |
| 4,928,760 | A * | 5/1990 | Freitas | 166/113 |
| 5,095,977 | A * | 3/1992 | Ford | 166/113 |
| 5,333,686 | A | 8/1994 | Vaughan et al. | |
| 6,009,941 | A * | 1/2000 | Haynes | 166/72 |
| 2006/0181288 | A1 * | 8/2006 | Gilboe | 324/691 |

FOREIGN PATENT DOCUMENTS

EP 0353838 2/1990

OTHER PUBLICATIONS

International Search Report and Written Opinion for corresponding PCT Application No. PCT/US2011/036178, dated Sep. 29, 2011.

* cited by examiner

*Primary Examiner* — Nicole Coy

(57) ABSTRACT

Embodiments may take the form of a tool string sub. The tool string sub may include a longitudinally extending tubular housing having an outside surface and an inside surface. A stepped circumferential portion of the inside surface of the housing bisects the interior surface of the housing. A degradation part is connected adjacent to the stepped portion of the housing and is supported by the housing and at least one moveable support part protruding inward and beyond the inner surface of the housing. The support part has a first position where the degradation part is at first stress and a second position where the degradation part is at a second stress greater than the first stress. At least one end of the tool string sub is adapted to connect with a tool string.

18 Claims, 3 Drawing Sheets

APPARATUS AND METHOD FOR MONITORING CORROSION AND CRACKING OF ALLOYS DURING LIVE WELL TESTING

CROSS-REFERENCE TO RELATED APPLICATION

The present document is based on and claims priority to U.S. Provisional Application Ser. No. 61/334,170, filed May 12, 2010.

TECHNICAL FIELD

The present application relates to downhole oilwell equipment, and more particularly, to corrosion and cracking material determination.

BACKGROUND

Fluids and gasses are contained in the earth. Many of these fluids and gasses are desirable and valuable for consumption purposes, e.g., gas, oil and water. To extract these fluids, a well is drilled into the earth. The wells can be very deep and often up to a mile or more in depth. These wells can be vertical or horizontal or a combination thereof.

Once a well is drilled, at least a portion of the well is generally lined with a metal casing. This metal casing can have cement filled between the outside of the casing and the earth formation to fill empty spaces.

After the casing is implemented, completions are located in the well to relay tools, packers, and to produce fluids. The completions often include piping or tubing, valves, and/or other well known instruments.

There are production areas along the wellbore, e.g., where oil is present, and others where oil is not present or present to a lesser degree. Given that, it is often desirable to only extract fluids from one section of the well. When that is the case, packers are used to isolate a portion of the wellbore from other portions for fluid extraction purposes. Often, the portion of the wellbore that is to be produced is perforated with a perforating gun while that portion remains separate.

Downhole environments can be very harsh. The fluids that are extracted are often quite harsh themselves, and additional fluids are often present. These additional fluids can be acidic and otherwise degrade various materials used to make completions and other equipment. In addition, high temperatures and pressures can be present. Frictional degradation and physical wear (e.g., from abrasives present in a well) can also be faced. In sum, tools placed downhole in wells face a number of factors that can all contribute to degradation of a tool material.

Accordingly, it is desirable to gain knowledge of potential degradation of various materials when exposed to actual wellbore environments.

SUMMARY

An embodiment according to the present application includes a tool string sub. A longitudinally extending tubular housing has an outside surface and an inside surface. A stepped circumferential portion of the inside surface of the housing bisects the interior surface of the housing. A degradation part is connected adjacent to the stepped portion of the housing and is supported by the housing and at least one moveable support part protruding inward and beyond the inner surface of the housing. The support part has a first position where the degradation part is at one stress and a second position where the degradation part is at a second stress greater than the first stress. The present application relates to embodiments that can be capable of varying the stresses on the degradation part from zero to beyond its yield strength. Also the stresses can be induced not only using screws, sliding keys or wedges, but by the geometry of the housing itself. At least one end of the tool string sub is adapted to connect with a tool string.

BRIEF SUMMARY OF THE FIGURES

The brief description of the figures is not meant to unduly limit any claims in this or any related application.

DETAILED DESCRIPTION

The following description concerns a number of embodiments and is meant to provide an understanding of the embodiments. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Corrosion and environmental cracking of downhole alloys in fit for service tests are generally conducted in simulated bottomhole fluids at P-T conditions. Equilibrium of co-existing phases is normally a question in the time scale of a test (30 to 90 days) in contrast to geological time (millions of years). Also, exposure can be in fluids that are static (extremely difficult to simulate high flow rates and associated dynamic flow effects (eddies' etc.)). It is apparent that simulated bottomhole tests along these lines have various drawback that would make actual bottomhole testing preferable.

Various embodiments in the present application relate to apparatus and methods for monitoring corrosion and cracking of alloys during live well testing. These can improve understanding of survivability of materials, particularly that of lower alloys and coatings, when exposed to downhole wellbore environments. According to embodiments, a sub containing corrosion and stressed C-rings (degradation parts) could be integrated and deployed with a testing tool string or be an integrated part of any other tool string. The tool string could be deployed on drill pipe, production tubing, coil tubing, or wireline. The C-ring or corrosion coupons or any other stressed degradation parts could then be removed with the tool string, drill pipe or tubing, and evaluated. The information gathered would have value to those involved in the selection of materials for use in a particular well completion string or other tooling. This could also apply to selection of coatings for tooling and completions in wells.

According to embodiments, a number of factors for the C-ring or corrosion coupons or any other stressed or unstressed degradation parts (degradation part) can be evaluated such as corrosion and cracking of the part itself and of any coatings applied there to during exposure to downhole environments. The degradation part can be made from any material which is to be investigated.

Figure 1:
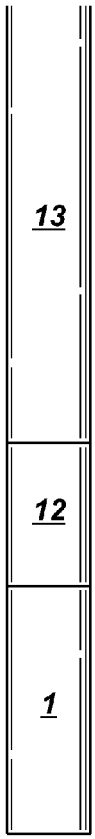
FIG. 1 shows a side schematic view of a tool string including an embodiment of the tool string sub.

Looking more specifically at the drawings, FIG. 1 shows a side schematic view of a portion of a tool string. The tool string has tubing 13 that in practice extends downhole into a well bore from surface. In place of the tubing, a wireline or slickline could be used. The tubing could be drill pipe, production tubing, or coil tubing. The tubing can be connected with a testing tool 12 (e.g., a closed chamber testing tool). The testing tool 12 can also be replaced with a perforating gun or an artificial lift device such as an electric submersible pump. Fracturing equipment can also be used. Also, SAGD equipment such as steam and heat producing devices, as well as drainage device, can be used. Below the testing tool 12 is connected a tool string sub 1 according to embodiments of the present application. It should be noted that the tool string sub 1 can be in the location shown in FIG. 1, but could also be located in other parts of a tool string (can be deployed at any depth of the well-position dependent design). For example, the tool string sub 1 could be above the testing tool 12. Also, more than one tool string sub 1 can be incorporated in a tool string at different locations. In cases where packers are used to isolate a zone of the well, the tool string sub 1 can be located below a safety valve that is in the tool string or tubing. However, in other configurations the tool string sub 1 can be located above a safety valve. However above the packer, where a tubing and annulus needs to be isolated, the sub needs sealing between these and fluid contact from the 10.

Figure 2:
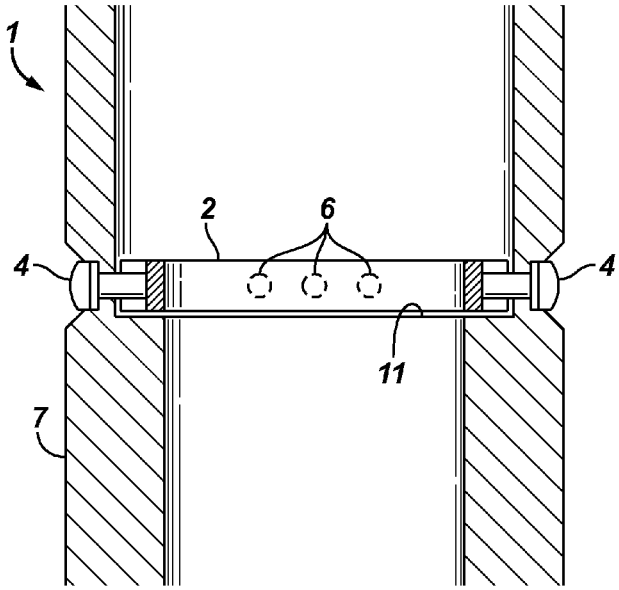
FIG. 2 shows a side section view of an embodiment of the tool string sub.

FIG. 2 is a side view section of a tool string sub 1 according to embodiments in the present application. The tool string sub 1 can be a longitudinally extending tubular part having a centerline as shown. The tool string sub 1 can be made from metal such as iron or steel, alloys and variations thereof. The tool string sub 1 has a housing 7 with an outside surface and an inside surface. In the embodiment shown in FIG. 1, the inside surface has a stepped portion 11 that extends around the internal circumference of the inner surface of the tool string sub 1 and bisects the inner surface of the tool string sub 1. The stepped portion 11 can divide an area of the tool string sub 1 having a smaller inside diameter from a side of the tool string sub 1 having a larger inside diameter. However, the stepped portion 11 could also be part of a protrusion or lip extending around the inner surface of the tool string sub 1. The inner sleeve will prevent corroded/cracked pieces from falling into the well bore.

A degradation part 2 (C-Ring in FIG. 2) is shown as being located adjacent to and supported by the stepped portion 11. The degradation parts can be stacked enabling study of crevice, pitting corrosion and environmental cracking of galvanically coupled alloys. A plurality of support parts 4 in the form of screws extend through the housing 7 of the tool string sub 1 and contact/support the C-ring. When in a first position (unscrewed) the support parts (screws) 3 maintain the C-ring at a first stress. When in a second position (screwed) the support parts (screws) 3 maintain the C-ring (degradation part) 2 at a second stress that is greater than the first stress. The stresses expressed on the degradation part could be 0 to 100% of temperature rated yield strength of the material being tested. The thickness of the tool string sub could be 0.5 to 4 inches. The length of the tool string sub could be from 2 to 6 feet long. These dimensions correspond to the normal requirements of well tools of this sort. Also, the tool string sub could be an integral part of any tool string. These dimensions in connection with the resultant strength attributes lend to an ability to perform properly in downhole activities. Additionally, the support parts can be non-moveable where the degradation part is forced into a stressed position.

Perforations 6 are shown extending through the housing 7 of the tool string sub 1 from the outside of the tool string sub 1 to the inside surface of the tool string sub proximate the degradation part 2. The perforations can be designed to allow flow of well fluids from outside the tool string sub 1 to the inside of the tool string sub 1 to contact the degradation part 2 or from inside and also prevent outside to inside flow if needed. The perforations can have a diameter of approximately 0.25 to 1 inch or slots.

Figure 3:
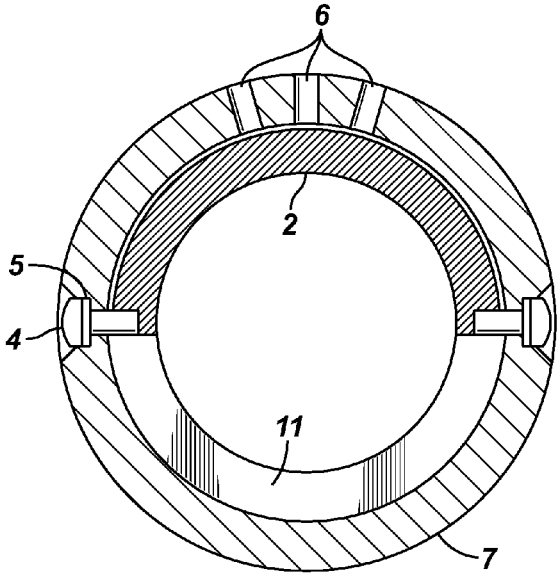
FIG. 3 shows a top section view of an embodiment of the tool string sub.

FIG. 3 shows a top sectional view of a tool string sub 1 according to embodiments. The tool string sub 1 has as housing 7 with a stepped portion 11. A degradation, part 2 (C-ring) (or corrosion coupons or any other stressed degradation parts) is located adjacent to and supported by the stepped portion 11. Two support parts 4 interact with the C-ring 2 (or corrosion coupons or any other intentionally stressed or stressable degradation parts). When in a second position the support parts 4 create a stress on the C-ring 2. O-rings 5 can be incorporated with the support parts 4 for protection. Perforations 6 extend through the housing 7 and are proximate to the ring-type degradation part 2.

Figure 4:
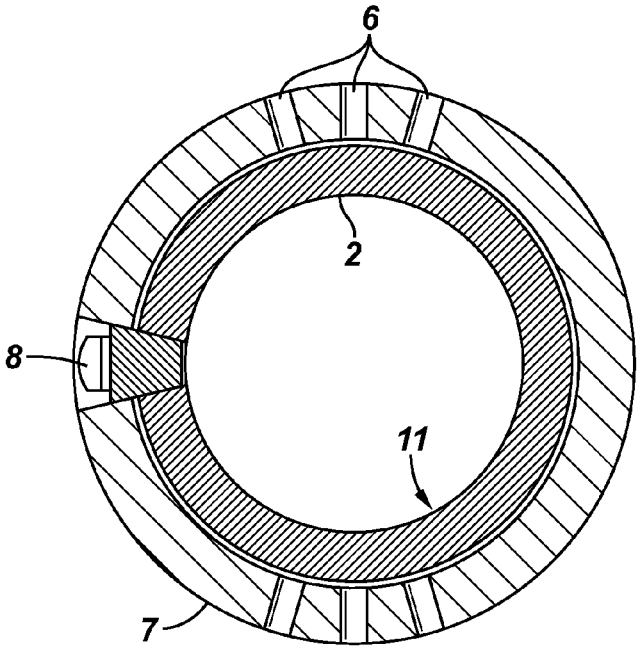
FIG. 4 shows a top section view of an embodiment of the tool string sub.

FIG. 4 shows a top sectional view of the tool string sub 1 according to embodiments. In FIG. 4, the degradation part 2 is almost a full 360 degree ring and only has one opening therein. The degradation part 2 is again supported proximate the stepped portion 11. In FIG. 4 a wedge 8 interacts with the opening in the degradation part 2 and exerts force on the degradation part 2 so as to create a stress in the degradation part 2. Perforations 6 extend through the housing 7. The stress directions on the degradation parts can be reversed. Stresses can be either compressive or tensile on either the inner or outer fiber of the degradation part as required.

Figure 5:
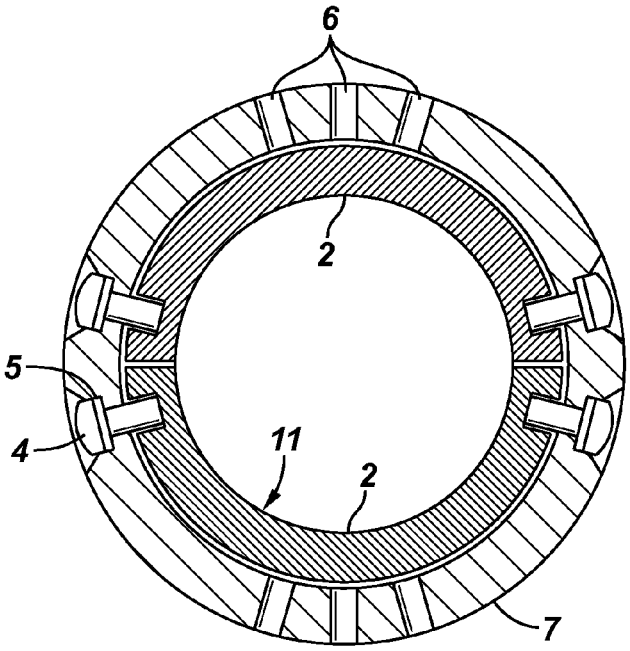
FIG. 5 shows a top section view of an embodiment of a tool string sub.

FIG. 5 shows a top sectional view of a tool string sub 1 according to embodiments of the present application. In this design, each half of the tool string sub 1 is a mirror image of the other. The tool string sub 1 has two C-rings 2, each with two support parts (screws) 4. The degradation parts (C-rings) 2 are supported by the stepped portion 11 and are contacted by the support parts (screws) 3. Perforations 6 extend through the housing 7 proximate the C-rings 2.

Figure 6:
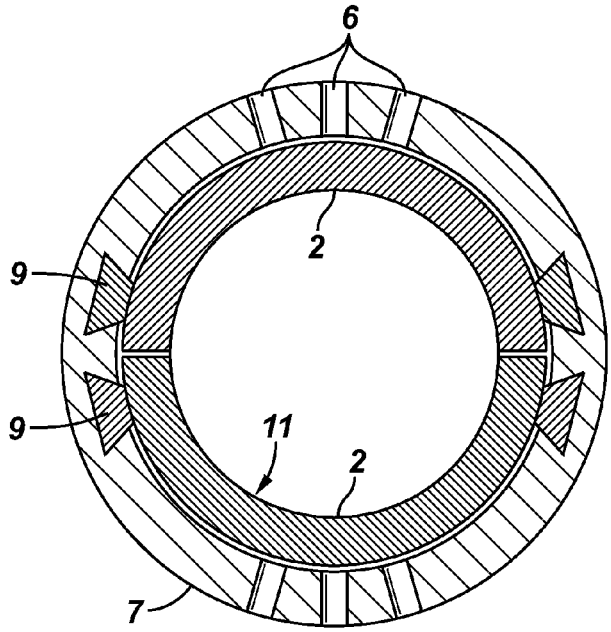
FIG. 6 shows a top section view of an embodiment of a tool string sub.

FIG. 6 shows a similar design as in FIG. 5, except includes support parts 4 that are keys. The keys are located in key slots 9. When the keys are in the key slots 9, the C-ring has stress applied thereto. Perforations 6 extend through the housing 7.

Figure 7:
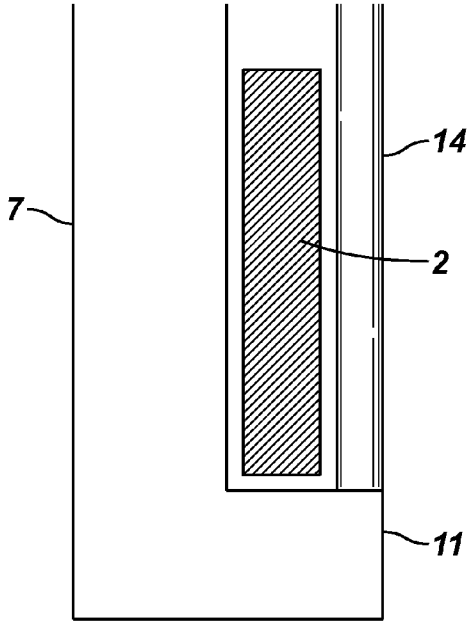
FIG. 7 shows a side section partial view of an embodiment of a tool string sub with an inner tubular member.

FIG. 7 shows a side sectional view of a portion of a tool string sub 1 according to embodiments in the present application. The housing 7 of the tool string sub 1 has a stepped portion 11. The stepped portion 11 is adjacent to and supports an inner tubular part 14. A degradation part 2 is contained in a space defined by the inner surface of the housing 7, the stepped portion 11 and the inner tubular part 14. The degradation part 2 is up hole from the stepped portion 11 so as to prevent the degradation part 2 from falling downhole.

The tool string sub will also allow a study of stressed degradation parts to be exposed to annulus fluids above the packer to study effects of corrosion and environmental cracking in completions brines, such as Cesium Formate and Acetate, etc. The flexibility to run this tool string sub (design based) anywhere along the tubing, above or below the packer will be relevant in acquiring corrosion data at various temperatures, pressures and locations (below or above dew point of produced vapors), to help design upper-middle or lower completions.

The preceding description is meant to help one skilled in the art understand the embodiments described herein and is not in any way mean to unduly limit the scope of any present or subsequent claims.

We claim:

1. A tool string sub, comprising:

a longitudinally extending tubular housing, the housing having an outside surface and an inside surface;

a stepped circumferential portion of the inside surface of the housing bisects the inside surface of the housing;

a stressable ring degradation part is connected adjacent to the stepped circumferential portion of the housing and is supported by the housing and at least one moveable support part protruding inward and beyond the inside surface of the housing, the support part to express an intentional stress over a body of the stressable ring degradation part; and at least one end of the tool string sub adapted to connect with a tool string.

2. The tool string of claim 1, wherein the degradation part is in an arc shape.

3. The tool string of claim 2, wherein the arc shaped degradation part extends circumferentially around the inside surface of the housing at least approximately 180 degrees.

4. The tool string of claim 1, wherein the support part is a screw extending through the housing.

5. The tool string of claim 1, wherein the support part is a wedge shaped part.

6. The tool string of claim 1, wherein the housing comprises perforations extending from outside the housing through the housing to a location proximate the degradation part.

7. A method of determining reaction of a stressable ring degradation part to downhole elements, comprising:

a tool string, the tool string including a actuable downhole tool;

locating the stressable ring degradation part in a tool string sub, wherein locating the stressable ring degradation part comprises placing the stressable ring degradation part in a stepped circumferential portion of an inside surface of the tool string sub;

expressing a stress over a body of the stressable ring degradation part of up to 100% of a temperature rated yield strength for a material of the part being tested;

locating the tool string and the sub downhole;

actuating the downhole tool;

removing the tool string and sub from downhole;

removing the degradation part from the sub and making measurements of parameters of the degradation part.

8. The method of claim 7, wherein the degradation part is C shaped.

9. The method of claim 7, wherein expressing the stress compresses rotating a screw.

10. The method of claim 7, wherein the support part is a wedge.

11. The method of claim 7, wherein the support part is static and the degradation part is forced into a stressed position supported by the support part.

12. The method of claim 7, comprising locating the degradation part adjacent to a stepped circumferential portion of an inside surface of the housing that bisects the inside surface of the housing.

13. The method of claim 7, wherein the downhole tool is a perforating gun.

14. The method of claim 7, wherein the downhole tool is an electric submersible pump.

15. The method of claim 7, wherein the downhole tool is a testing device.

16. A tool string sub, comprising:

a longitudinally extending tubular housing, the housing having an outside surface and an inside surface;

a stepped circumferential portion of the inside surface of the housing bisects the inside surface of the housing;

a stressable ring degradation part is connected adjacent to the stepped circumferential portion of the housing;

an inner tubular part is supported on an inner portion of the stepped circumferential portion of the housing so that the inner tubular part and the inside surface of the housing are on opposite sides of the stressable ring degradation part thereby constraining the stressable ring degradation part in a cavity defined by the inside surface of the housing, an outer surface of the inner tubular part and the stepped circumferential portion of the housing; and a moveable support member that contacts the stressable ring degradation part to express an intentional stress over a body thereof, the stress of up to 100% of a temperature rated yield strength for a material of the part being tested.

17. The tool string sub of claim 16, wherein the degradation part is in a shape of an arc.

18. The tool string sub of claim 16, wherein perforations extend from the outside of the housing through the housing to a location proximate to the degradation part.

* * * * *